US005721574A

United States Patent [19]

Kubby

[11] Patent Number: 5,721,574

[45] Date of Patent: Feb. 24, 1998

[54] INK DETECTING MECHANISM FOR A LIQUID INK PRINTER

[75] Inventor: Joel A. Kubby, Rochester, N.Y.

[73] Assignee: Xerox Corporation, Stamford, Conn.

[21] Appl. No.: 570,299

[22] Filed: Dec. 11, 1995

[51] Int. Cl.[6] ..... B41J 2/01

[52] U.S. Cl. ..... 347/7

[58] Field of Search ..... 347/7, 85, 86, 347/87, 19, 5

[56] References Cited

U.S. PATENT DOCUMENTS

| | | | |
|---|---|---|---|
| 5,072,235 | 12/1991 | Slowik et al. | 346/1.1 |
| 5,250,957 | 10/1993 | Onozato | 347/7 |
| 5,488,395 | 1/1996 | Takayanagi et al. | 347/7 |

*Primary Examiner*—Benjamin R. Fuller
*Assistant Examiner*—Craig A. Hallacher
*Attorney, Agent, or Firm*—Daniel J. Krieger

[57] ABSTRACT

An ink detecting mechanism for a liquid ink printer including a liquid ink printhead having a plurality of ink carrying conduits terminated by an ink ejecting orifice. The ink detecting mechanism detects the presence of ink within the ink carrying conduits and includes a normally open circuit maintained in an open condition when said ink carrying conduit lacks the presence of ink. The fluid detecting device includes a detecting probe spaced from a transducer element located in the ink carrying conduit such that the presence of ink is detected for between the location of the detecting probe and the location of the transducer element. A signal is generated by a detection circuit for each of the channels of the printhead. Each signal is then summed and a decision signal is generated indicating whether or not the entire array of printhead nozzles should be primed. The detection of ink within the channels is performed without the need for ejecting ink from the channels.

16 Claims, 4 Drawing Sheets

INK DETECTING MECHANISM FOR A LIQUID INK PRINTER

FIELD OF THE INVENTION

The present invention relates generally to a liquid ink printing apparatus, and more particularly, to an ink detecting mechanism for detecting the presence of ink in the ink carrying conduits of a liquid ink printhead.

BACKGROUND OF THE INVENTION

Liquid ink printers of the type frequently referred to as continuous stream or as drop-on-demand, such as piezoelectric, acoustic, phase change wax-based, or thermal, have at least one printhead from which droplets of ink are directed towards a recording medium. Within the printhead, the ink is contained in a plurality of ink carrying conduits or channels. Power pulses cause the droplets of ink to be expelled as required from orifices or nozzles at the ends of the channels.

In a thermal ink-jet printer, the power pulse is usually produced by a heater transducer or a resistor, typically associated with one of the channels. Each resistor is individually addressable to heat and vaporize ink in the channels. As voltage is applied across a selected resistor, a vapor bubble grows in the associated channel and initially bulges toward the channel orifice followed by collapse of the bubble. The ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of the recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

It has been recognized that there is a need to maintain the ink ejecting nozzles of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles and also periodically to maintain proper functioning of the nozzles. Maintenance and/or priming stations for the printheads of various types of ink jet printer are described in, for example, U.S. Pat. Nos. 4,855,764; 4,853,717 and 4,746,938 while the removal of gas from the ink reservoir of a printhead during printing is described in U.S. Pat. No. 4,679,059.

Ink channels do not always fill with ink as intended due to the presence of air bubbles or contaminants which may block the channel from receiving ink from the ink supply. In addition, an air bubble can also form when air is ingested through the nozzle which prevents the channel from proper refill. It is also possible that the heater itself can generate an undesirable bubble by degassing the ink when thermal energy is applied to the ink. In each instance, the presence of air at any point along the channel will degrade printing performance.

While priming of the printhead nozzles is particularly effective in removing air bubbles, priming of the printhead nozzles is typically performed after a printing defect occurs, and therefore results in wasted documents having printing defects. For instance, priming is often performed when a user perceives that print quality is less than desirable. Printheads are also primed according to a predetermined schedule based on various factors such as time between print jobs or length of documents being printed. If priming is performed according to a predetermined schedule, priming may be performed unnecessarily resulting in wasted ink. In addition, it is possible to detect the formation of non-collapsible bubbles at the heater element by detecting the amount of current drawn by the heater while being energized. In each of these instances, however, at least a portion of a document has been printed or ink has been ejected with the consequence being that a problem has been detected after the fact resulting in wasted time and material.

In U.S. Pat. No. 5,072,235 to Slowik et al., a method and apparatus for the electronic detection of air inside a thermal ink jet printhead is described. A detection circuit for detecting the existence of non-collapsing bubbles in the ink cells of a thermal ink jet printhead is connected to a heater element of an ink containing cell. Current traveling through the heater element is sensed to detect the presence of a non-collapsing bubble.

SUMMARY OF THE INVENTION

In accordance with one aspect of the present invention, there is provided a liquid ink printer of the type in which liquid ink is deposited on a recording medium comprising a liquid ink printhead including an ink carrying conduit terminated by an ink ejecting orifice. The liquid ink printer includes a fluid detecting device, detecting the presence of ink within the ink carrying conduit wherein the fluid detecting device includes a detection circuit maintained in an open condition when the ink carrying conduit lacks the presence of ink.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
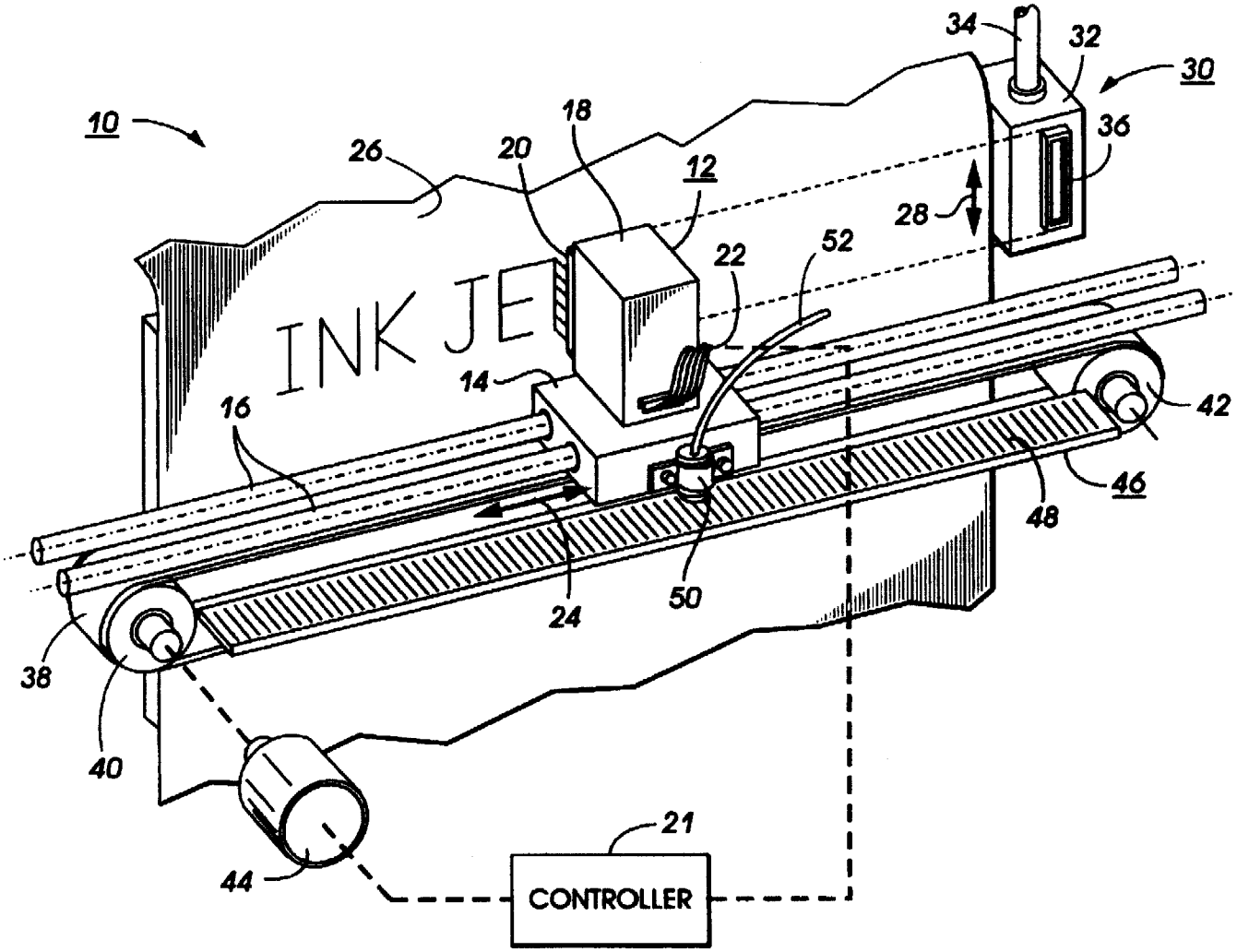
FIG. 1 is a partial schematic perspective view of an ink jet printer having an ink jet printhead, incorporating the present invention.

FIG. 1 illustrates a partial schematic perspective view of an ink jet printer 10 having an ink jet printhead cartridge 12 mounted on a carriage 14 supported by carriage rails 16. The printhead cartridge 12 includes a housing 18 containing ink for supply to a thermal ink jet printhead 20 which selectively expels droplets of ink under control of electrical signals received from a controller 21 of the printer 10 through an electrical cable 22. The printhead 20 contains a plurality of ink conduits or channels (not shown) which carry ink from the housing 18 to respective ink ejectors, which eject ink through orifices or nozzles (also not shown). When printing, the carriage 14 reciprocates or scans back and forth along the carriage rails 16 in the directions of an arrow 24. As the printhead cartridge 12 reciprocates back and forth across a recording medium 26, such as a sheet of paper or transparency, droplets of ink are expelled from selected ones of the printhead nozzles towards the sheet of paper 26. The ink ejecting orifices or nozzles are typically arranged in a linear array substantially perpendicular to the scanning direction 24. During each pass of the carriage 14, the recording medium 26 is held in a stationary position. At the end of each pass, however, the recording medium is stepped by a stepping mechanism under control of the printer controller 21 in the direction of an arrow 28. For a more detailed explanation of the printhead and printing thereby, refer to U.S. Pat. No. 4,571,599 and U.S. Pat. No. Reissue 32,572, the relevant portions of which are incorporated herein by reference.

It is well known and commonplace to program and execute imaging, printing, document, and/or paper handling control functions and logic with software instructions for conventional or general purpose microprocessors. This is taught by various prior patents and commercial products. Such programing or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. That can include object oriented software development environments, such as C++. Alternatively, the disclosed system or method may be implemented partially or fully in hardware, using standard logic circuits or a single chip using VLSI designs.

At one side of the printer 10, outside a printing zone which encompasses the width of the recording medium 26, is a maintenance station 30, a portion thereof which is illustrated. At the end of a printing operation, or at other times when necessary, the printhead carriage 12 is parked in a maintenance position confronting the maintenance station 30 which includes a chamber 32 to which a suction device is connected or through which a vacuum is applied through a vacuum line 34. The chamber 32 has attached thereto a maintenance/priming element 36 which contacts the printhead 20 when the carriage is located in the maintenance station position. During a priming operation, a vacuum pump (not shown) applies a vacuum to the vacuum line 34 through a waste tank (not shown) for removing ink or debris and/or for maintaining the ink-jet nozzles of the printhead 20. The maintenance/priming element 36, in contact with the printhead 20, maintains an airtight seal around the printhead nozzles for withdrawing ink or debris from the nozzles. U.S. Pat. No. 5,210,550 describes a maintenance station for ink-jet printers in more detail, the relevant portions of which are incorporated herein by reference.

The carriage 14 is moved back and forth in the scanning directions 24 by a belt 38 attached thereto. The belt 38 is driven by a first rotatable pulley 40 and a second rotatable pulley 42. The first rotatable pulley 40 is, in turn, driven by a reversible motor 44 under control of the controller 21 of the ink jet printer. In addition to the toothed belt/pulley system for causing the carriage to move, it is also possible to control the motion of the carriage by using a cable/capstan, lead screw or other mechanisms as known by those skilled in the art.

To control the movement and/or position of the carriage 14 along the carriage rails 16, the printer includes an encoder having an encoder strip 46 which includes a series of fiducial marks in a pattern 48. The pattern 48 is sensed by a sensor 50, such as a photodiode/light source attached to the printhead carriage 14. The sensor 50 includes a cable 52 which transmits electrical signals representing the sensed fiducial marks of the pattern 48 to the printer controller.

The ink jet printer 10, of FIG. 1, includes the printhead 20 which can be of the type known as thermal ink jet, piezoelectric, for other known types of printheads which eject liquid ink on a recording medium. For purposes of the present discussion, however, reference will be made to a thermal ink jet type of printhead which is more fully described in, for instance, U.S. Pat. No. 4,638,337 to Torpey et al., herein incorporated by reference.

Figure 2:
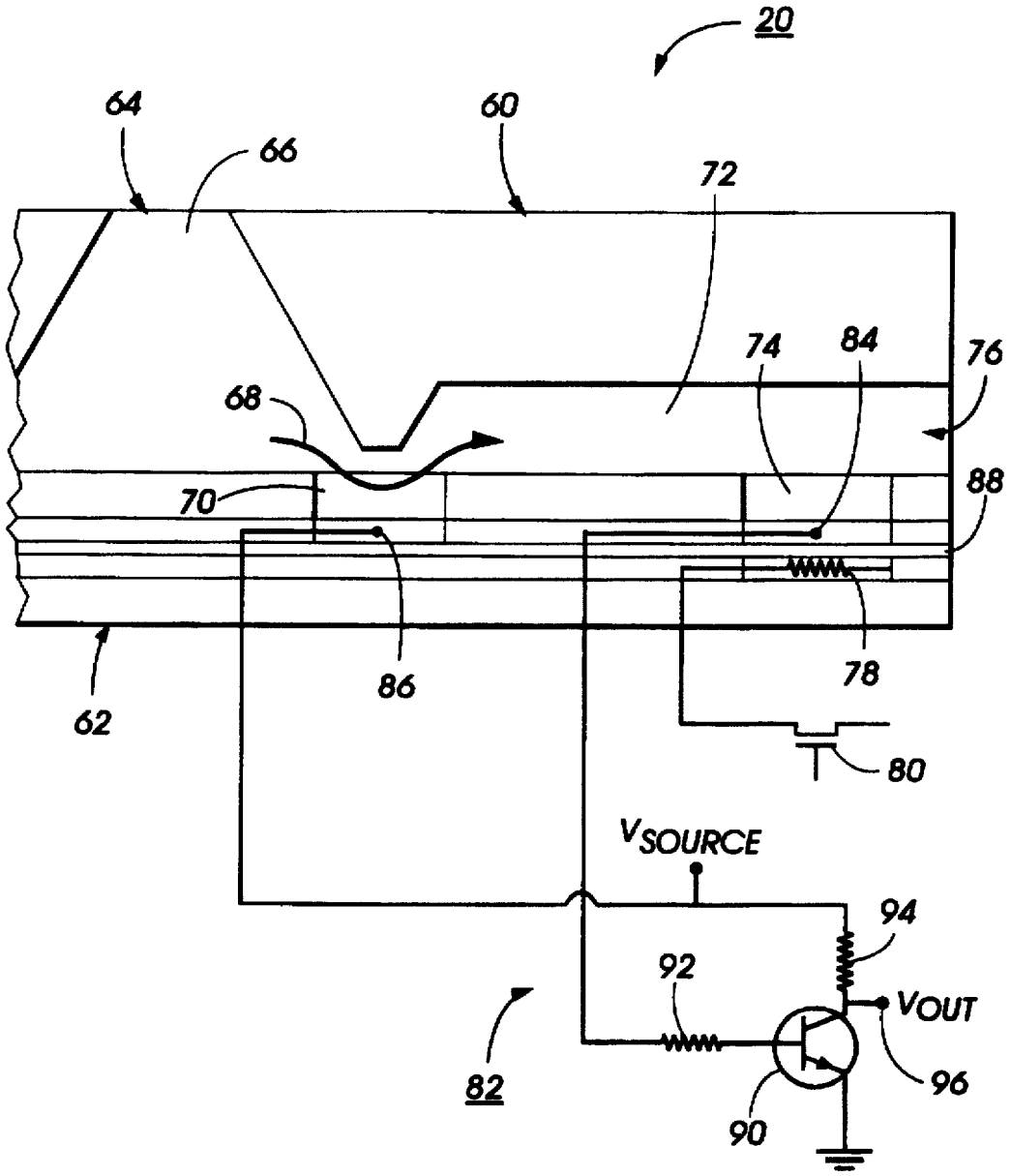
FIG. 2 is a sectional side view of an ink jet printhead incorporating the present invention.

FIG. 2 illustrates a partial schematic side view of the printhead 20. The printhead 20 includes an ink directing element 60, also known as a channel element, mated and aligned to a transducer element 62, also known as a heater element. The printhead 20 receives ink from a supply of ink (not shown) through an ink feed slot 64 defined in the ink directing element 60. Ink is received from the supply of ink and passes through the ink feed slot 64 into an ink reservoir 66 which contains an amount of ink which eventually flows therefrom in the direction of an arrow 68 through an ink pit 70 defined in the transducer element 62. The ink pit 70, which is more fully described in U.S. Pat. No. 4,774,530 to Hawkins, herein incorporated by reference, provides for an ink flow path from the ink reservoir 66 into an ink carrying conduit 72 (also known as a channel) defined by the mated ink directing element 60 and transducer element 62. The ink flows through the channel 72 filling the channel as well as a heater pit 74 defined in the transducer element 62. The ink flows up to a nozzle opening or orifice 76 but does not weep therefrom due to the surface tension from a meniscus of the ink at the nozzle 76. During printing, a transducer 78, also known as a heater element, is activated by a driver transducer 80 which heats the ink located in the heater pit 74 and within the channel 72 above the heater pit. A bubble is formed in the ink due to the thermal energy generated by the heater 78 and ink is ejected from the nozzle 76 upon collapse of the bubble once the heater is no longer energized. For a more detailed discussion of the energization of the heaters of a thermal ink jet printhead, refer to U.S. Pat. No. 5,300,968 to Hawkins, herein incorporated by reference.

During operation of the printhead 20, it has been found that ink may not properly flow along the ink flow path 68 and consequently does not completely fill the channel 72 which is necessary for the proper operation of the printhead. This problem often results from the formation of air bubbles within the ink reservoir 66 which can become lodged at a location near or at the ink pit 70. In this case, ink does not adequately flow into the channel 72 and the channel 72 is instead filled with air, resulting in no feeding of ink into the channel, a condition also know as "dropout". Such a condition causes a printing defect since the channel has no ink which can be expelled from the nozzle 76 upon demand. Even if the channel does adequately fill with ink, a second problem can result after the ink is ejected from the nozzle wherein air is ingested back into the nozzle thereby preventing proper refill of the channel as required. In addition, the thermal energy generated by the transducer 78 can also degas the ink located within the channel. That is, if the ink contains a sufficient amount of air (which is typically undesirable), the air present as small bubbles will coalesce into larger bubbles which can prevent proper ejection of ink from the channel.

These problems are typically corrected by priming the ink jet printhead by moving the printhead cartridge 12 to a position located in front of the maintenance station 30 where priming can be completed. In addition, priming is typically performed after ink has been ejected from the channels. The present invention, however, includes a mechanism for determining whether or not the channel 72 has properly filled with ink, without the need for ejecting ink. As illustrated in FIG. 2, the present invention includes a fluid detecting device having a detection circuit 82 normally maintained in an open condition when the ink carrying channels 72 lack the presence of ink. The detecting circuit 82 includes a first detecting probe 84 subtending the heater pit 74 and a second detecting probe 86 subtending the ink pit 70. In the illustrated embodiment, the transducer element 78 is electrically isolated from the first detection probe 84 by an insulating layer 88. The first detection probe 84, which is deposited upon the insulating layer 88, can include any number of known electrical conductors, including tantalum, as is described in U.S. Pat. No. 4,638,337. The second detecting probe 86, likewise, can include any number of electrical conductors including that of tantalum.

The fluid detection circuit 82 is a solid state switch including a transistor 90 having the base thereof coupled to the first detection probe 84 through a resistor 92. The collector of the transistor 90 is coupled to the second detecting probe 86 through a resistor 94. At the junction of the second detecting probe 86 and the resistor 94, a voltage source is applied for supplying power to the detection circuit 82. In operation, detection circuit 82 detects the presence of fluid between the first detection probe 84 and the second detection probe 86. In the presence of a fluid, the transistor 90 is turned on, pulling its collector low. In this way, when a fluid is present in the channel 72 an output signal $V_{out}$ present at the collector 96 is low. When a fluid is not present, the transistor 90 is off and the output signal at the collector 96 is pulled high through the resistor 94. It has been found that by properly selecting the voltage source, the value of the resistors 92 and 94 and the selection of the transistor 90, that the conductivity of the ink, which can vary and which closes the circuit between the first detection probe 84 and the second detection probe 86, can be compensated for so that proper detection of ink within the channel is readily determined. In addition, when inks with low conductivity are used, it may be necessary to replace to the transistor 90 with two or more transistors arranged in a series configuration to increase the gain, such as in a "Darlington pair", which is known by those skilled in the art.

Figure 3:
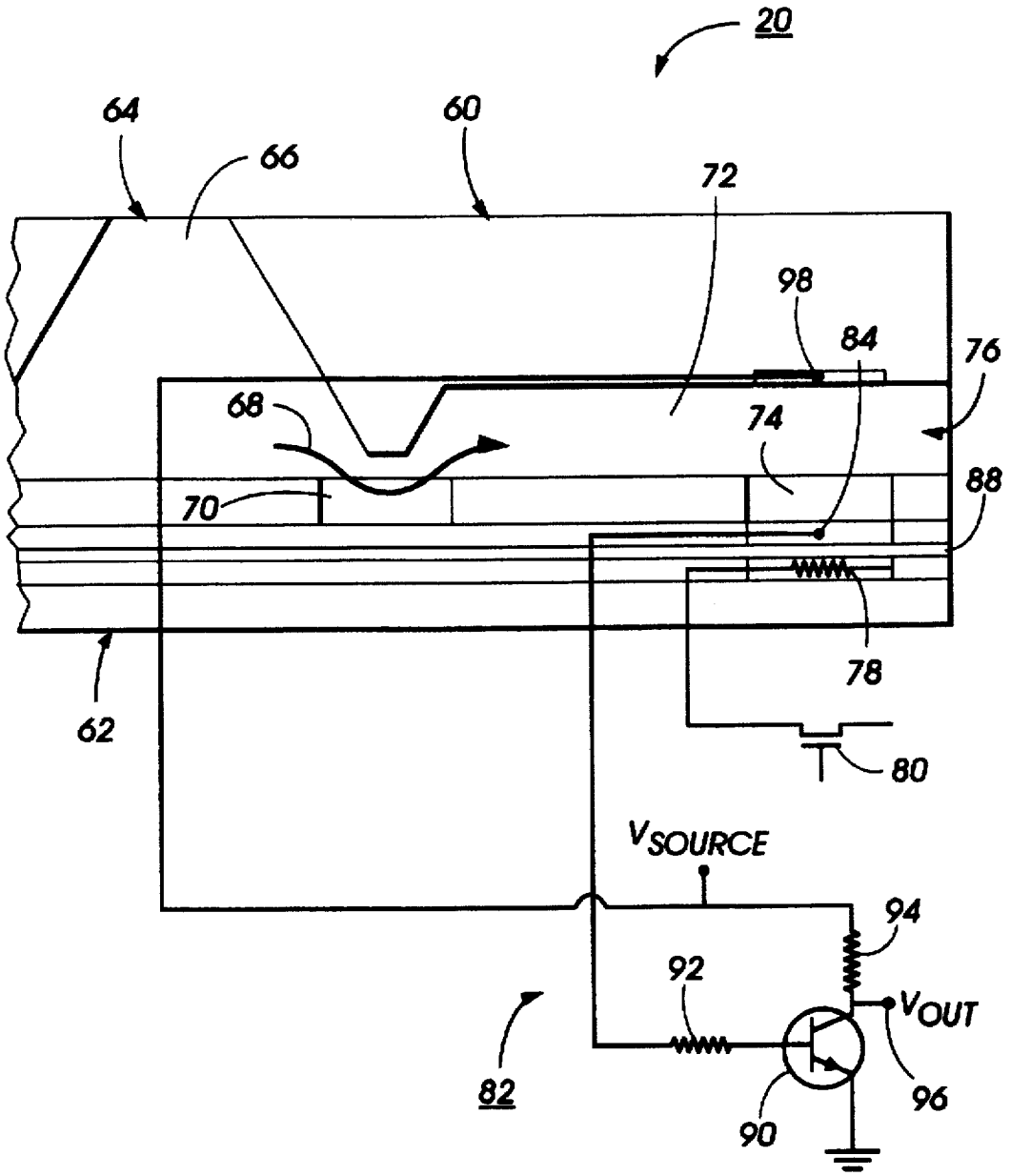
FIG. 3 is a sectional side view of an ink jet printhead incorporating another embodiment of the present invention.

FIG. 3 illustrates a second embodiment of the present invention, wherein a second detecting probe 98 is incorporated into the ink directing element 60 directly above the heater pit 74. The second detecting probe 98 can be deposited on the transducer element 60 by any known deposition techniques and can include any number of electrical conductors, including tantalum as previously described. In this embodiment, the presence of ink is detected directly above the heater pit 74 and may be useful for detecting for the previously described problems of ingestion of air through the nozzle 76 or degassing of the ink.

It is also possible to locate the first detecting probe 84 in a location other than those previously described or in a variety of locations such that ink filling problems resulting from various printhead configurations can be more readily determined. For instance, the nozzles located at either end of an array can be more likely to not fill with ink than nozzles in the middle, since these nozzles are located at the ends of the ink reservoir 66 where air bubbles tend to collect. Consequently, it might be possible to locate the first detection probe at the heater pit and the second detection probe at the bypass pit for one or more nozzles located at opposite ends of the linear array of nozzles in a single printhead die.

By placing a pair of probes, associated with each channel of a linear array of channels in a printhead, the presence of ink within each channel can be monitored via the output, $V_{out}$, of the individual switches. Using the presently described detection circuit 82, a signal can be generated for each of the channels of the printhead. Since the presence of ink can be detected within each channel, it is possible that by monitoring the output signals from each detection circuit, a decision can be made as to whether or not the printhead needs to be primed. For instance, while it is possible to prime when a single channel does not fill with ink, it may not be necessary to prime, since the printer might be printing in a draft mode wherein a lower quality of printing is acceptable. Likewise, the printer might include a printing algorithm which can compensate for the loss of some inkjet nozzles during printing.

Figure 4:
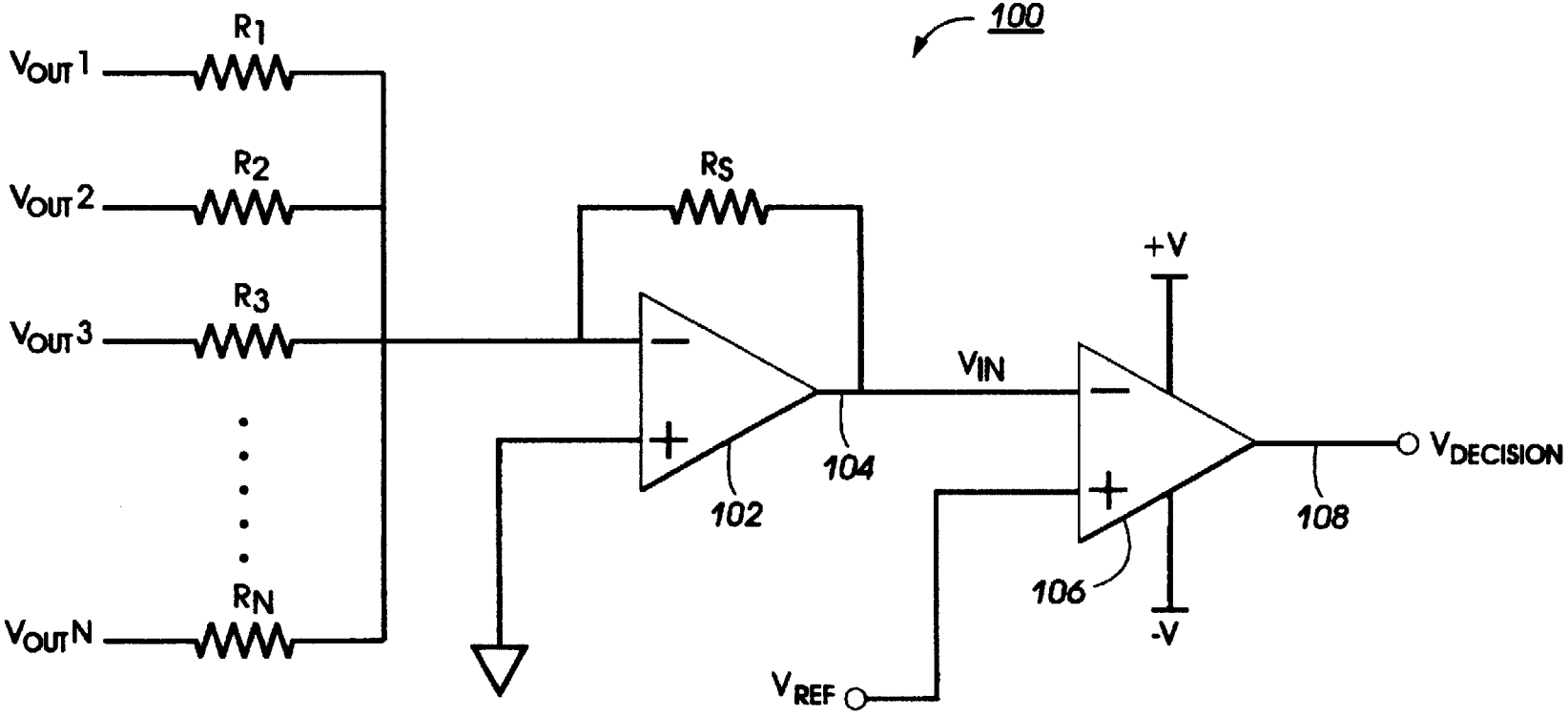
FIG. 4 is a circuit diagram of a circuit for determining when to prime the ink jet printhead.

FIG. 4 illustrates the generation of a decision signal which indicates whether or not repriming of the device is necessary. A decision circuit 100 receives a plurality of signals, $V_{out}1$-$V_{out}N$ from each of the individual detection circuits which are input to a summing operational amplifier 102 each individually through an input resistor R1-RN. At an output 104 of the summing amplifier 102, a signal is generated which is used to determine whether or not the printhead should be primed. The output signal available at the output 104, here described as $V_{in}$, is equal to:

$$-\sum_{i=1}^{N} V_{out}(R_S/R_i)$$

The status of each of the individual channels, shown as $V_{out}1$-$V_{out}N$, are summed together to generate the signal, $V_{in}$, which is then compared to a voltage reference signal, $V_{ref}$, input to a comparison operational amplifier 106. The summation signal, $V_{in}$, is compared to the reference voltage which has been previously selected such that if enough channels have not filled with ink, a priming decision signal $V_{decision}$ at an output 108 of the amplifier 106 is switched from −V to +V. This transition is then used as a signal for priming the entire ink jet printhead. It is also possible, to form a weighted sum of the inputs to the summation amplifier 102 by varying the value of the summing resistors R1-RN so that more important channels can be weighted more heavily. Since the present invention provides for the determination of whether or not the channels properly fill with ink, it is not necessary to eject ink from the channels to determine whether or not a problem exists. Consequently, the present invention detects proper refill without wasting ink. For instance, it is possible that after a printhead has been primed based on a periodic maintenance schedule, the printhead can be checked for proper priming by use of the present invention. Such a method of operation enables the printhead cartridge to return to printing with the knowledge that each of the individual channels have been properly primed without the need for observing a printed document to determine whether or not the priming operation has been successful. The present invention also provides for the continuous detection of proper refill of each of the channels for performing a high quality print mode. For instance, once ink is ejected from a nozzle, the channel refills within approximately 30 microseconds of ink depletion. Consequently, for a time period of approximately 50–100 microseconds after firing, it is possible to detect whether or not each of the individual ink channels has properly refilled. Since it is possible to determine whether or not an individual channel has been properly filled with ink, a high quality print mode can be achieved wherein the channels which do not refill with ink can be compensated for by a printing algorithm resident in the printer controller.

In recapitulation, there has been described an ink detecting mechanism for a liquid ink printer. The ink detecting mechanism of the present invention enables the determination of whether or not the ink carrying conduits of an ink jet printhead are properly filled with ink. It is, therefore, apparent that there has been provided in accordance with the present invention a fluid detecting device for detecting the presence of ink within a plurality of ink carrying conduits that fully satisfies the aims and advantages hereinbefore setforth. While this invention has been described by a specific embodiment thereof, it is evident that many alternatives, modifications, and variations will be apparent to those skilled in the art For instance, the present invention is not limited to scanning ink jet printheads but also includes an application for partial width array or page width array ink jet printers. Accordingly, it is intended to embrace all such alternatives, modifications, and variations that fall within the spirit and broad scope of the claims.

What is claimed is:

1. A liquid ink printer for depositing liquid ink on a recording medium, comprising:

a liquid ink printhead including a plurality of ink carrying conduits, each being terminated by an ink ejecting orifice; and a fluid detecting device connected to said plurality of ink carrying conduits, said fluid detecting device for detecting the presence of ink within each of said plurality of ink carrying conduits, said fluid detecting device including a detection circuit maintained in an open condition when at least one of said plurality of ink carrying conduits lacks the presence of ink.

2. The liquid ink printer of claim 1, wherein said liquid ink printhead comprises a plurality of transducers, each being disposed in one of said plurality of ink carrying conduits, each of said transducers for ejecting ink from said ink ejecting orifices.

3. The liquid ink printer of claim 2, wherein said fluid detecting device comprises a plurality of first detecting probes and a plurality of second detecting probes, each of said plurality of first detecting probes being associated with and spaced from one of said plurality of second detecting probes along one of said plurality of ink carrying conduits.

4. The liquid ink printer of claim 3, wherein said fluid detecting device comprises a plurality of detection circuits, each of said plurality of detection circuits for generating a signal, each of said plurality of detection circuits coupled to one of said plurality of first detecting probes and one of said plurality of second detecting probes associated therewith.

5. The liquid ink printer of claim 4, comprising a priming circuit, receiving said signal generated from each of said plurality of detection circuits and generating a priming signal indicating that said liquid ink printhead requires priming.

6. The liquid ink printer of claim 5, wherein each of said plurality of detection circuits comprises a switch.

7. The liquid ink printer of claim 1, wherein said liquid ink printhead comprises a thermal ink jet printhead including a plurality of heaters, each of said plurality of heaters disposed in one of said plurality of ink carrying conduits, for ejecting ink from said ink ejecting orifice, and a plurality of bypass pits each being spaced from one of said plurality of heaters by at least a portion of said ink carrying conduit.

8. The liquid ink printer of claim 7, wherein said fluid detecting device comprises a plurality of detecting probes, each of said plurality of detecting probes being located in one of said plurality of bypass pits, for detecting for the presence of ink in said ink carrying conduit.

9. The liquid ink printer of claim 8, wherein said fluid detecting device comprises a plurality of second detecting probes, for detecting the presence of ink, each of said plurality of second detecting probes being spaced from one of said plurality of heaters by an insulative material insulating said second detecting probe from said heater.

10. The liquid ink printer of claim 9, wherein said fluid detecting device comprises a plurality of detection circuits, each of said detection circuits being coupled to one of said first mentioned plurality of detecting probes and to one of said plurality of second detecting probes, said detection circuit generating a signal indicating the presence of ink within said ink carrying conduit.

11. The liquid ink printer of claim 10, comprising a priming circuit, receiving said signal generated from each of said plurality of detection circuits and generating a priming signal indicating that said thermal ink jet printhead requires priming.

12. The liquid ink printer of claim 1, wherein said liquid ink printhead comprises an orifice plate, defining a plurality of ink carrying channels, and a transducer plate, coupled to said orifice plate, defining with said orifice plate said plurality of ink carrying conduits and said plurality of ink ejecting orifices.

13. The liquid ink printer of claim 12, wherein said liquid ink printhead comprises a plurality of transducers disposed on said transducer plate, each of said plurality of transducers for ejecting ink from one of said plurality of ink ejecting orifices.

14. The liquid ink printer of claim 13, wherein said fluid detecting device comprises a plurality of detecting probes, coupled to said orifice plate, each of said plurality of detecting probes being spaced from one of said plurality of transducers, for detecting for the presence of ink between said detecting probe and said transducer.

15. The liquid ink printer of claim 14, wherein said fluid detecting device comprises a plurality of detection circuits, each of said plurality of detection circuits being coupled to one of said plurality of detecting probes, each of said detection circuits generating a signal indicating the presence of ink between said detecting probe and said transducer.

16. The liquid ink printer of claim 15, comprising a priming circuit, receiving said signal generated from each of said plurality of detection circuits and generating a priming signal indicating that said liquid ink printhead requires priming.

* * * * *